US005290428A

United States Patent [19]

Strausz et al.

[11] Patent Number: 5,290,428

[45] Date of Patent: Mar. 1, 1994

[54] SUPERACID CATALYZED HYDROCRACKING OF HEAVY OILS AND BITUMENS

[75] Inventors: Otto P. Strausz; Thomas W. Mojelsky; John D. Payzant, all of Edmonton, Canada; George A. Olah, Beverly Hills; Surya G. K. Prakash, Hacienda Heights, both of Calif.

[73] Assignee: Alberta Oil Sands Technology and Research Authority, Edmonton, Canada

[21] Appl. No.: 850,271

[22] Filed: Mar. 12, 1992

[51] Int. Cl.[5] ..... C10G 23/02

[52] U.S. Cl. ..... 208/107; 208/106; 208/112; 208/108

[58] Field of Search ..... 208/108, 111, 107

[56] References Cited

U.S. PATENT DOCUMENTS

| | | | |
|---|---|---|---|
| 1,791,562 | 2/1931 | Hofmann et al. | 208/108 |
| 2,127,577 | 7/1971 | Winkler et al. | 208/108 |
| 3,591,486 | 1/1974 | Peck et al. | 208/108 |
| 3,824,178 | 7/1974 | Wald | 208/108 |
| 4,036,737 | 7/1977 | Wristers et al. | 208/112 |
| 4,036,738 | 7/1978 | Wristers | 208/112 |
| 4,038,173 | 7/1977 | Myers | 208/112 |
| 4,051,015 | 9/1977 | Bearden, Jr. | 208/108 |
| 4,058,575 | 11/1971 | Cahn | 208/108 |
| 4,196,072 | 4/1980 | Aldridge et al. | 208/108 |
| 4,390,416 | 6/1983 | Ritter et al. | 208/108 |
| 4,394,247 | 7/1983 | Olah | 208/415 |
| 4,557,820 | 12/1985 | Paspek et al. | 208/108 |
| 4,740,295 | 4/1988 | Bearden, Jr. et al. | 208/108 |
| 4,950,386 | 8/1990 | Francisco | 208/108 |

*Primary Examiner*—Helane Myers

*Attorney, Agent, or Firm*—Bennett Jones Verchere

[57] ABSTRACT

A process is provided for hydrocracking a heavy oil bitumen and chemically related feedstock. The process comprises reacting said feedstock with a gaseous superacid in the presence of hydrogen with or without the use of a hydrogen transfer agent to thereby yield lower boiling point distillates.

20 Claims, 13 Drawing Sheets

SCAN 1082
324
243
230
215
201
185
173
159
151
143
137
129

SCAN 1102
325
243
216
202
193
187
179
173
162
151
143
135
129

SCAN 1156
324
257
243
229
215
201
185
177
171
165
159
151
143
137
131
100
0
140
160
180
200
220
240
260
280
300
320
340
MASS NUMBER

SUPERACID CATALYZED HYDROCRACKING OF HEAVY OILS AND BITUMENS

FIELD OF THE INVENTION

This invention relates to a process for the catalyzed hydrocracking of heavy hydrocarbons into a refinery treatable product.

BACKGROUND OF THE INVENTION

Hydrogenation processes for the upgrading of heavy cretaceons crude oil and bitumens are well known. Upgrading processes are normally carried out to remove or reduce the contaminants in the oil and to convert the heavier components of the oil into lower boiling point hydrocarbon products. The contaminants include the heteroatoms oxygen, sulphur and nitrogen and the metals vanadium, nickel and iron.

Current commercial upgrading processes typically involve the use of a heterogeneous catalyst, exemplary of which would be cobalt, molybdenum or nickel sulfides deposited on an alumina substrate. Deleteriously, the higher molecular weight components of the heavy oils tend to accumulate on the catalyst pellet surfaces, clogging the pore system and thus reducing the rate of hydrogenation. Ultimately, the deposition of coke and metals on the pellet surface will despoil the catalytic performance. This becomes a serious operational problem when feedstocks such as bitumen, which are high in asphaltenes are hydrocracked.

The types of reactor employed in hydrocracking processes typically comprise a tubular reactor containing a fixed bed of the catalysts mentioned supra, or a fluidized bed of catalyst. Recovery of spent catalyst, and indeed replacement thereof, is a major expenditure in the process.

Typical hydrocracking reaction conditions are undertaken at high temperatures, of the order of between 400°-840° C. and at high pressures namely about 2,000-3,000 psi or higher.

It would be desirable, therefore, if a process not requiring a solid catalyst and requiring less severe reaction conditions could be arrived at.

SUMMARY OF THE INVENTION

In accordance with the present invention there is provided a process for hydrocracking a heavy hydrocarbon to produce lower boiling point distillates. More specifically, the process involves reacting the feedstock with a gaseous superacid in the presence of hydrogen.

Preferably, addition of a hydrogen transfer agent to the reactants would be made.

Typical heavy hydrocarbon feedstocks would include heavy oil, bitumen or chemically related substances, for example, asphaltenes.

As the catalytic superacidic fluorine compound, acids which contain elements of group III, IV and/or V of the periodic table could be considered. Exemplary superacids would include, but are not limited to, $HF.BF_3$, $H_2SiF_6$ and $HPF_6$. Preferably, the superacid utilized would comprise $HF.BF_3$.

As stated earlier, it is a preferred condition that the hydrogenation reaction take place in the presence of a hydrogen transfer agent. Suitable hydrogen transfer agents would comprise the cycloalkanes and low molecular weight alkanes. Particularly suitable hydrogen transfer agents include methylcyclohexane (MeCH), methylcyclopentane, dimethylcyclohexane or dimethcyclopentane. The preferred hydrogen transfer agent would be methylcyclohexane.

Preferred conditions for the hydrogenation reaction are such that the reaction is conducted at temperatures ranging from between 25° C. and 300° C. A preferred temperature range would be between 170° C. and 250° C. It will be readily appreciated however, by one skilled in the art, that if the temperature is too low, no reaction takes place and if too high, molecular over-degradation will result.

The requisite reaction time would probably range between one to twenty four hours. However, there exists the possibility of instantaneous reaction, and thus the time is not to be restricted to this stated range.

Again, there is no criticality with respect to pressure. Typically, the $HF.BF_3$ pressure would be 500 psi.

As a result of practising the present process, the bitumen or heavy oil feedstock is rendered into lower boiling point distillates. Advantageously under the mild conditions of the process the bitumen is converted to volatiles in at least a 56% yield in one hour. Additionally, removal of the undesirable heteroatoms is effected. Furthermore, a reduction in the vanadium, nickel and iron content takes place.

Following the hydrogenation reaction, the superacid $HF.BF_3$ has to be removed prior to further processing of the reaction products and this is easily and inexpensively done because of the high volatility and solubility of the superacid in water. Thus, the catalyst is reusable without involving a complex regeneration technique.

The main facets of $HF.BF_3$ superacid catalysis may be summarized as follows:

the catalyst molecule diffuses to the substrate molecule;

the $HF.BF_3$ activates the hydrocarbon, unlike conventional catalysts which activate the hydrogen molecule;

catalysis proceeds efficiently at low temperature and hydrogen pressure;

catalysis involves an ionic mechanism versus the free radical mechanism of conventional catalysis and therefore it results in different, more desirable products; and fluorine incorporation into the bitumen products does not occur.

When these characteristics are taken in conjunction with the ready separability of HF and $BF_3$ from the hydrocracking products and with their reusability it becomes evident that the $HF.BF_3$ superacid catalyzed hydrocracking of oil sand bitumens offers good potential for commercial application.

Broadly stated the invention comprises a process for hydrocracking a heavy oil bitumen, or chemically related feedstock, which comprises reacting said feedstock with a gaseous superacid preferably in the presence of a hydrogen transfer agent and hydrogen to thereby yield low boiling point distillates.

DESCRIPTION OF THE PREFERRED EMBODIMENT

Figure 1:
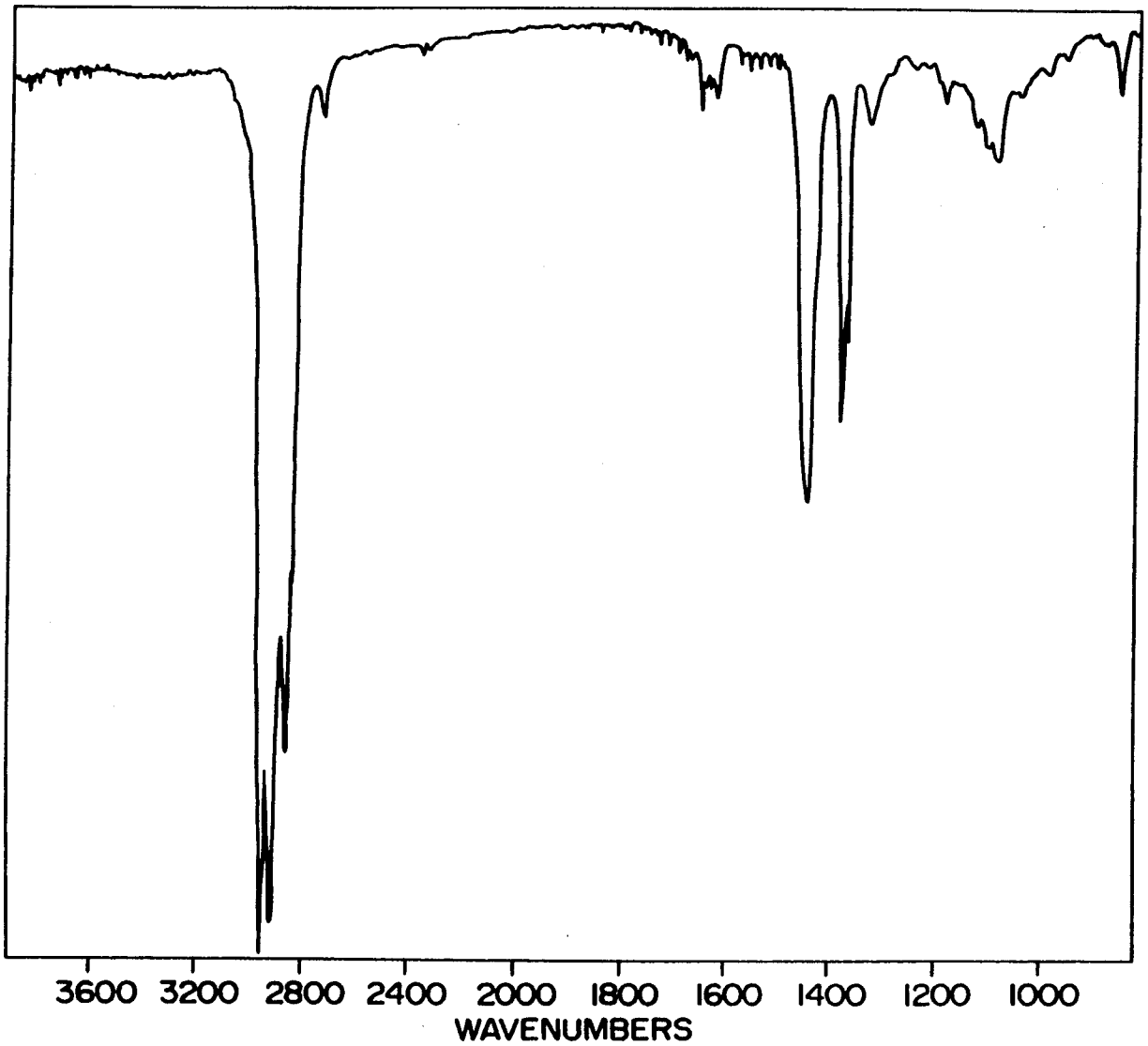
FIG. 1 is an infrared spectrum (IR) of the "saturate" fraction of Cold Lake (CL) superacid-treated asphaltene, stored under $N_2$.
Figure 2:
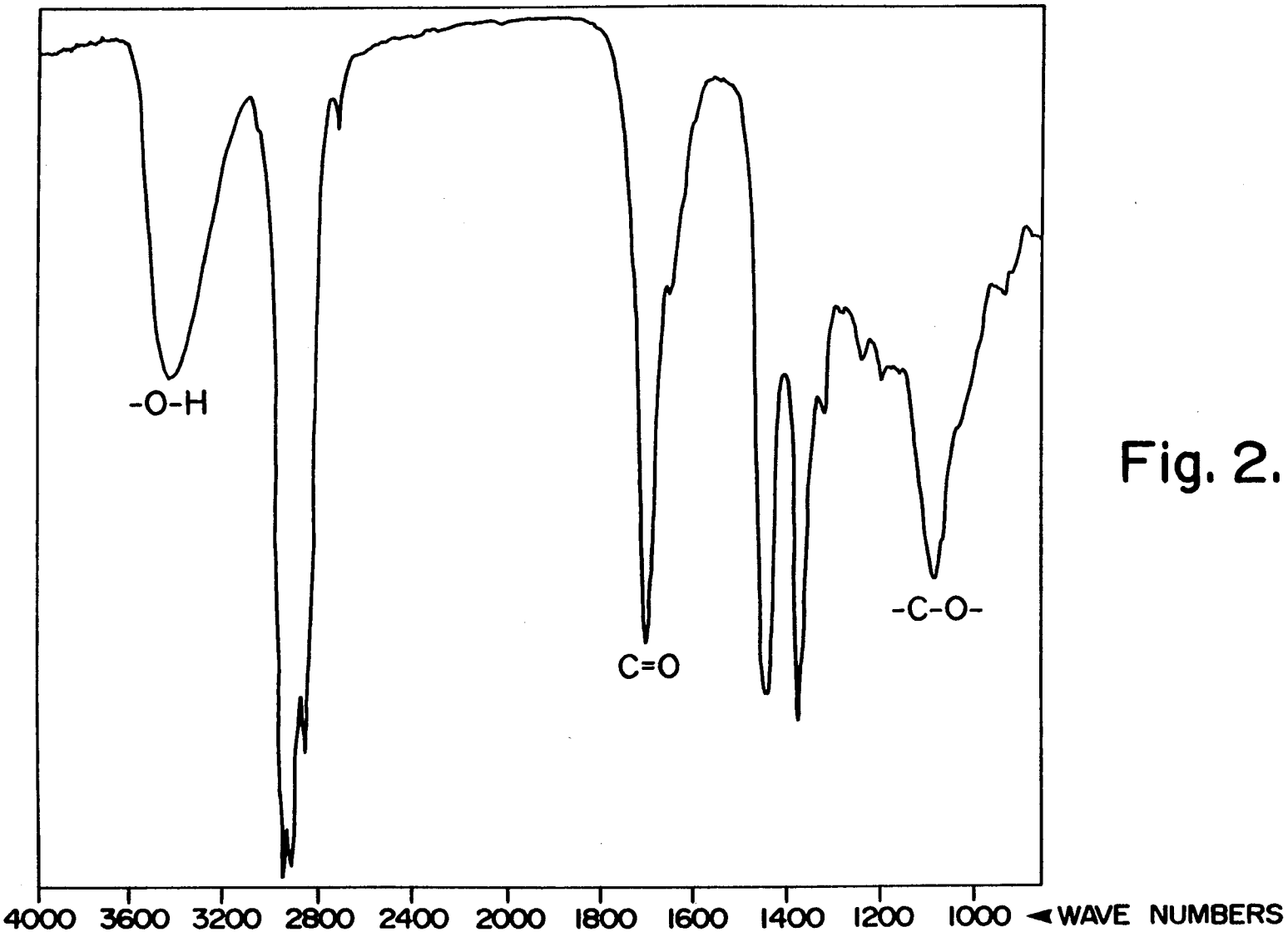
FIG. 2 is an IR spectrum of the "saturate" fraction of CL superacid - treated asphaltene exposed to air.
Figure 3:
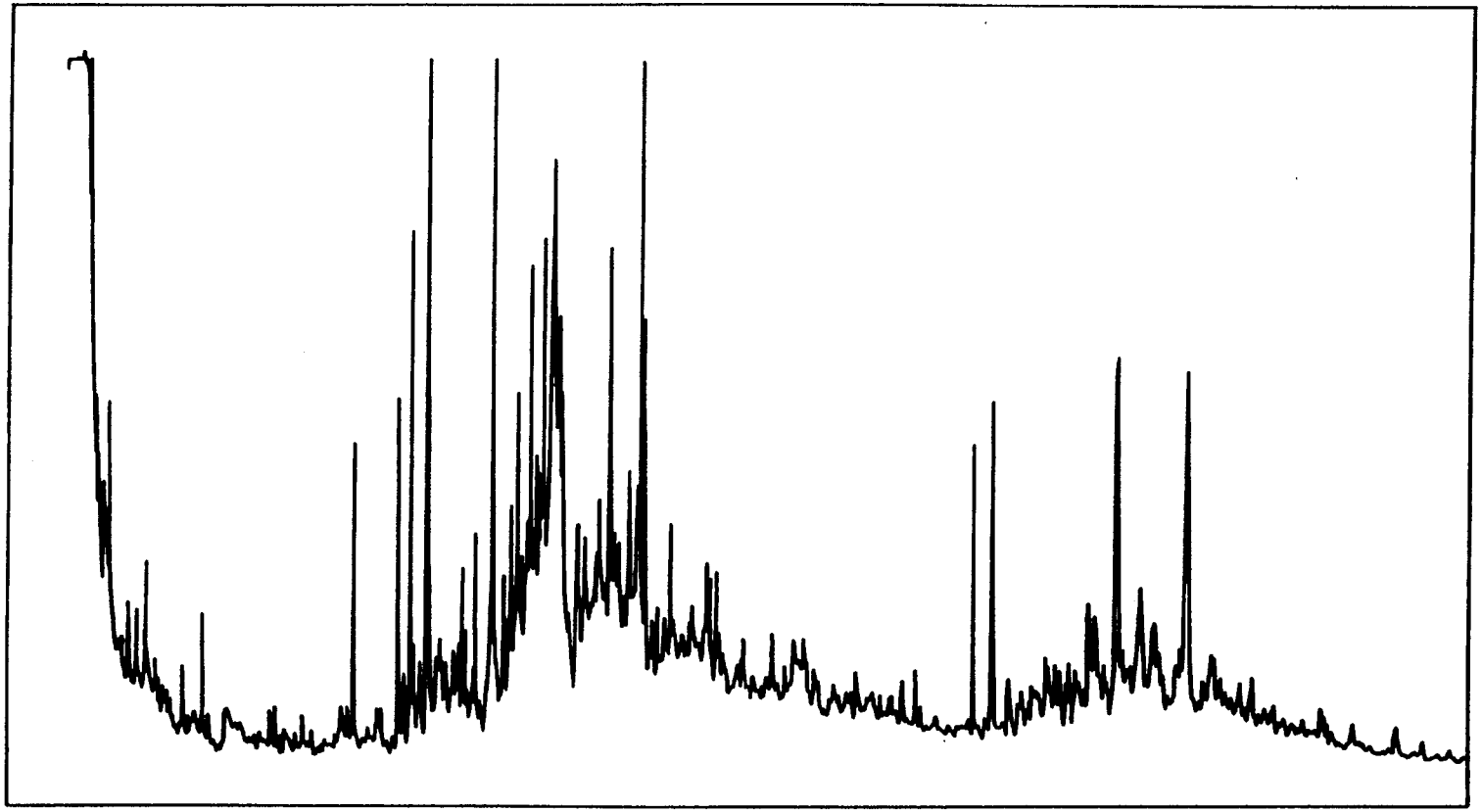
FIG. 3 is a gas chromatogram of the "saturate" fraction of CL superacid - treated asphaltene.
Figure 4:
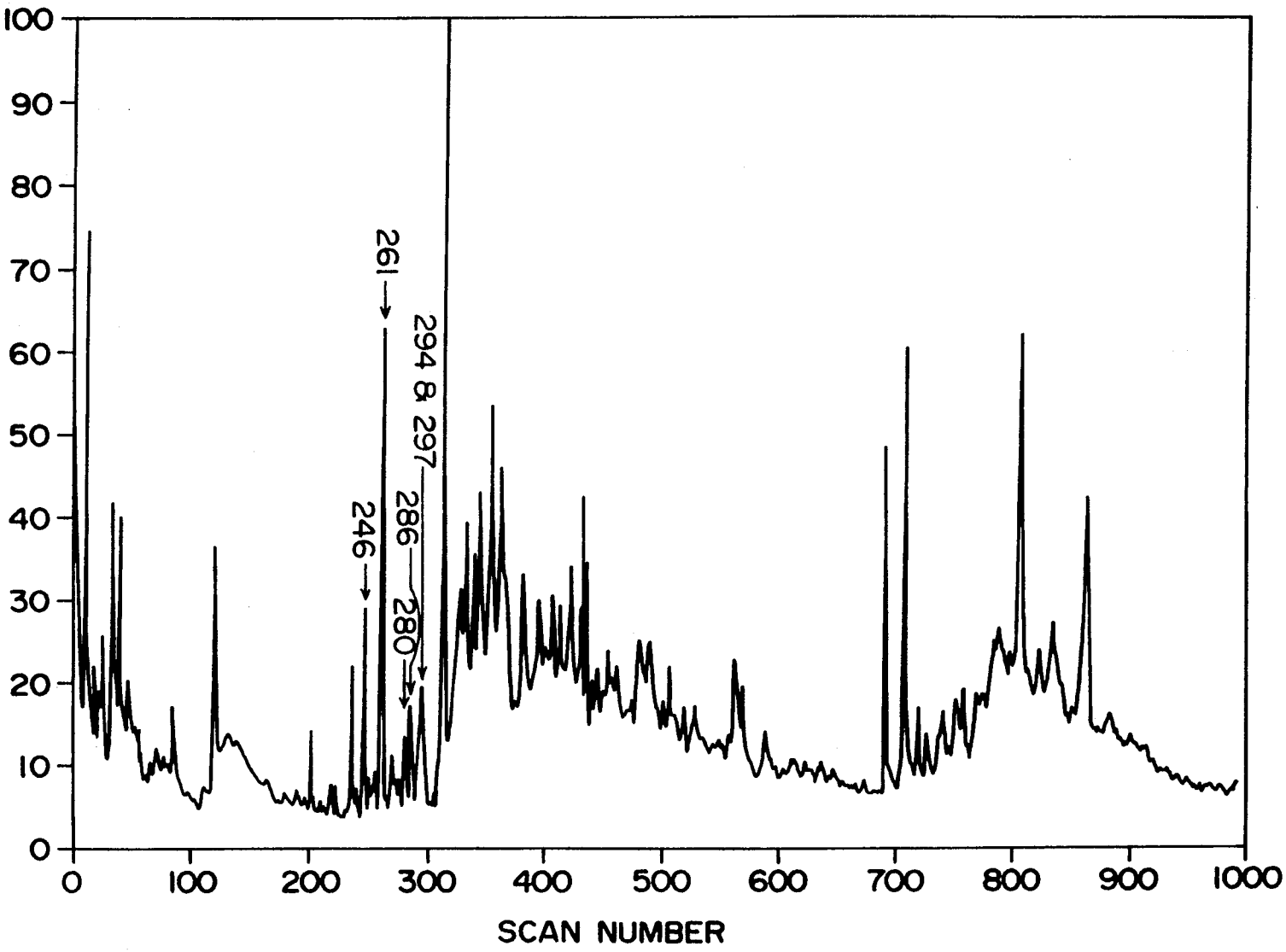
FIG. 4 is a mass chromatogram (GCMS) of the "saturate" fraction of CL superacid - treated asphaltene.
Figures 5A, 5B, 5C:
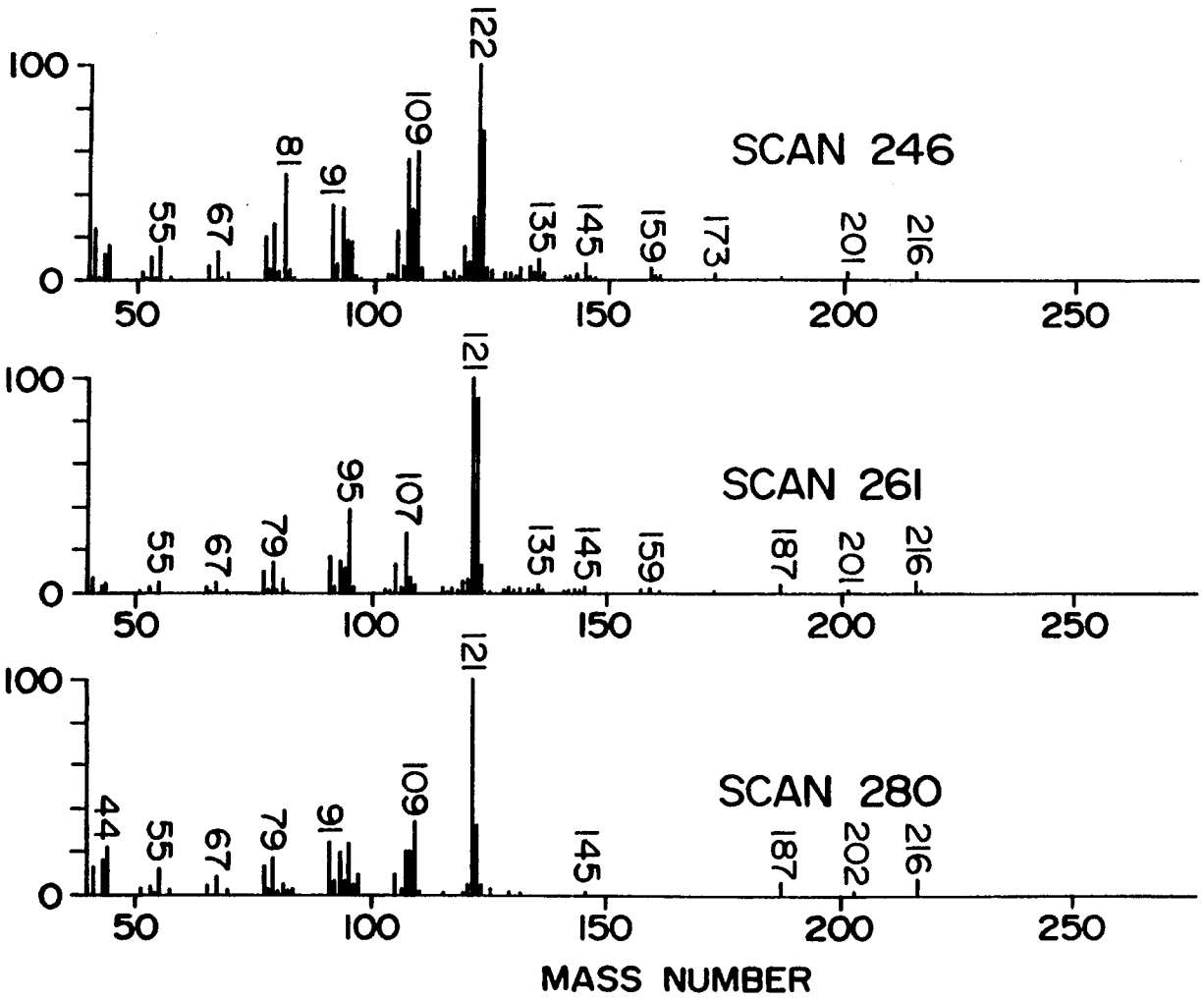
FIG. 5*a*, 5*b* and 5*c* are a mass spectra of scans 246, 261 and 280 ($C_{16}H_{24}$) of FIG. 4.
Figures 6A, 6B, 6C:
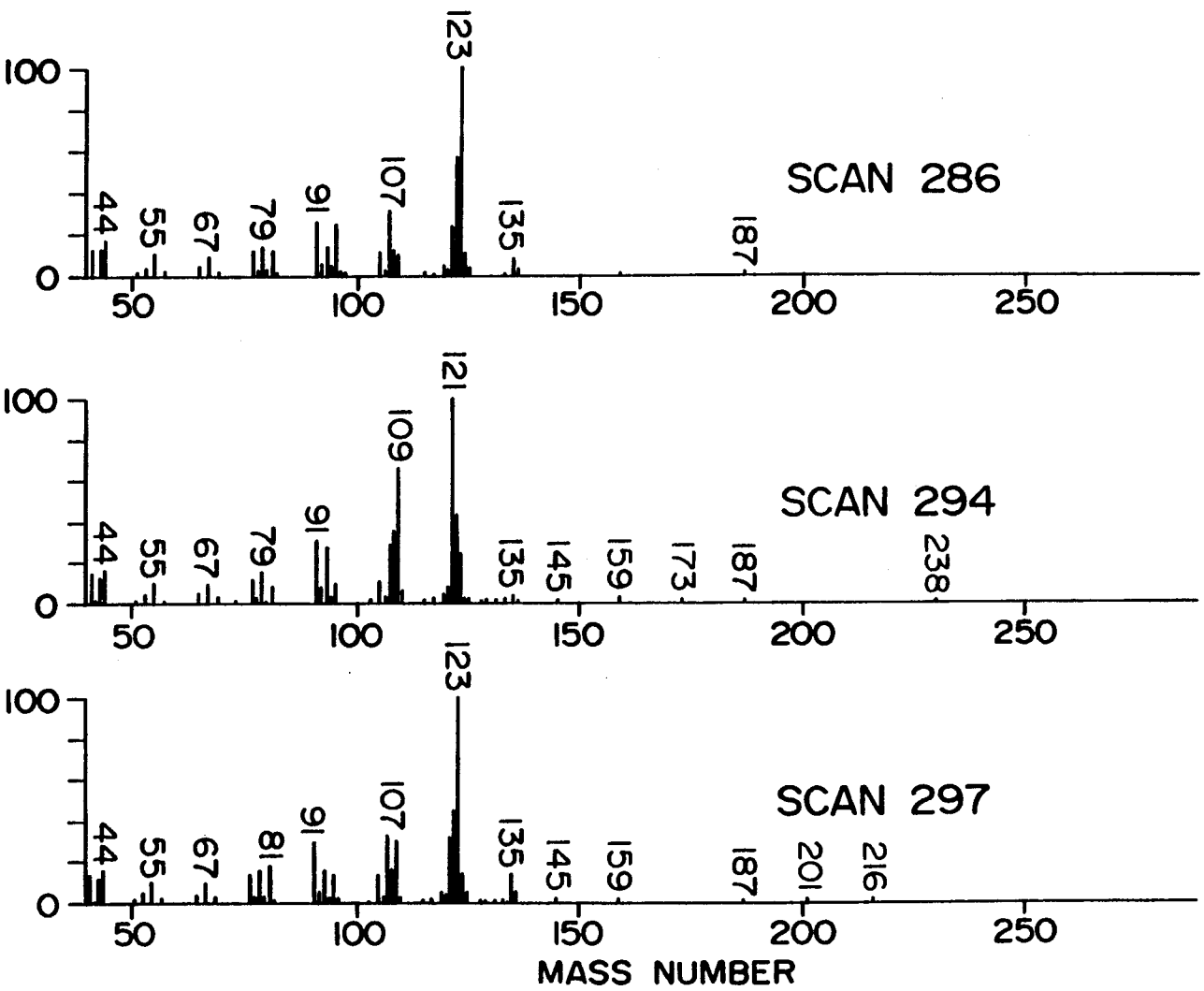
FIGS. 6*a*, 6*b* and 6*c* are a mass spectra of scans 286 ($C_{16}H_{24}$), 294 and 297 ($C_{17}H_{26}$) of FIG. 4.
Figure 7:
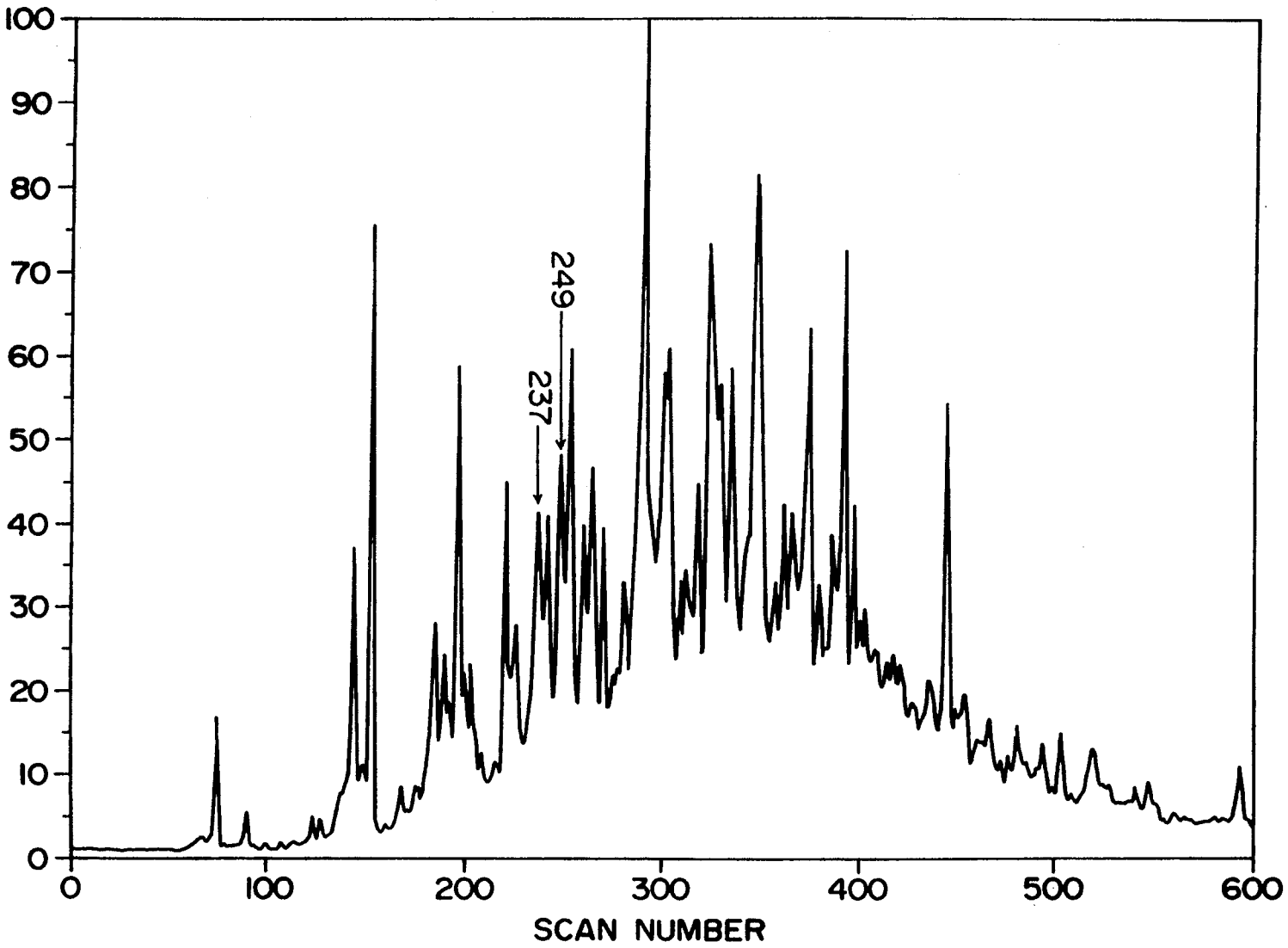
FIG. 7 is a mass chromatogram (GCMS) of the "saturate" fraction of CL superacid - treated asphaltene after ionic hydrogenation.
Figures 8A, 8B:
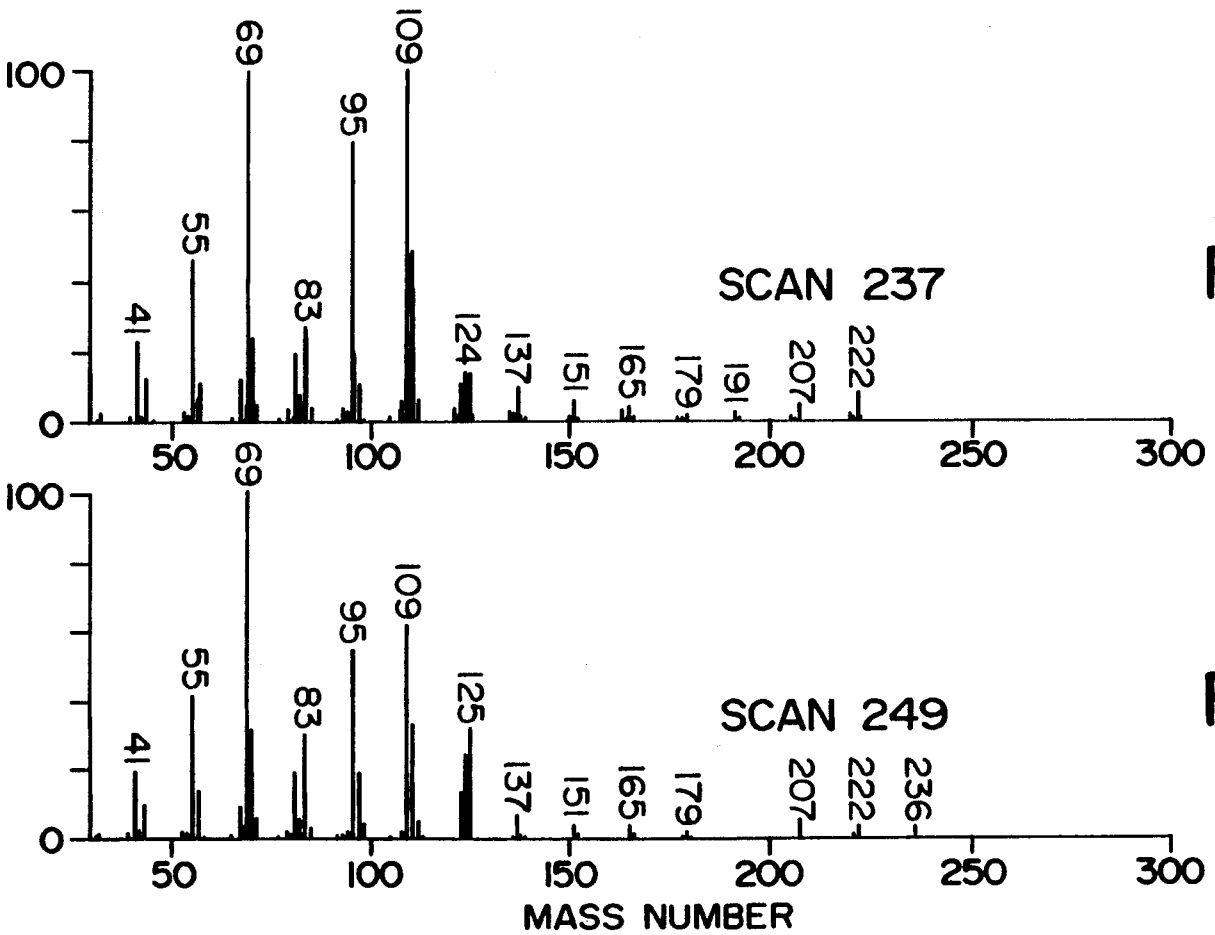
FIGS. 8*a* and 8*b* are the mass spectra of scans 237 ($C_{16}H_{30}$) and 249 ($C_{17}H_{32}$) of FIG. 7.
Figure 9:
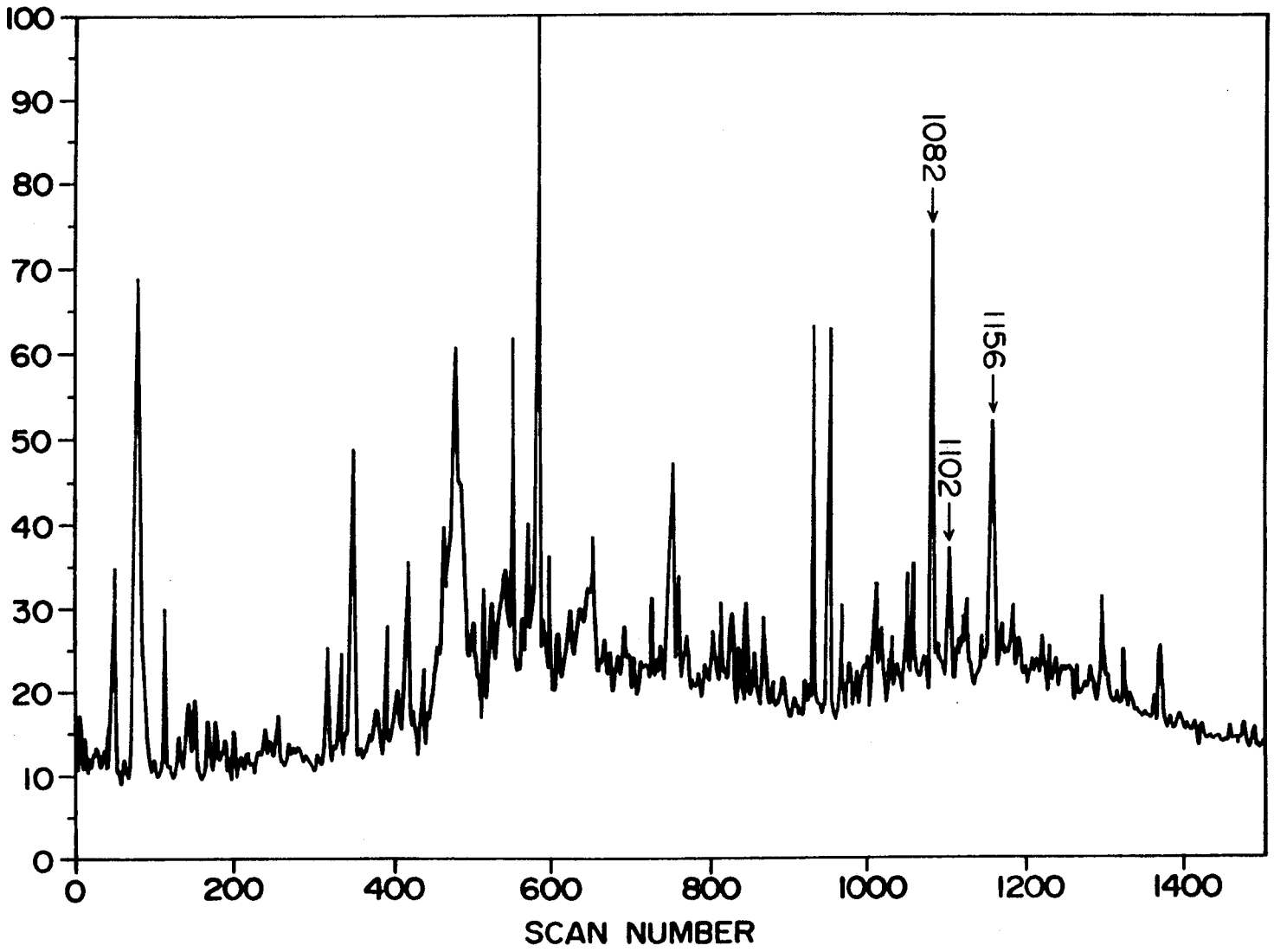
FIG. 9 is a chemical ionization mass chromatogram GCMS of the "saturate" fraction of CL superacid - treated asphaltene.
Figures 10A, 10B, 10C:
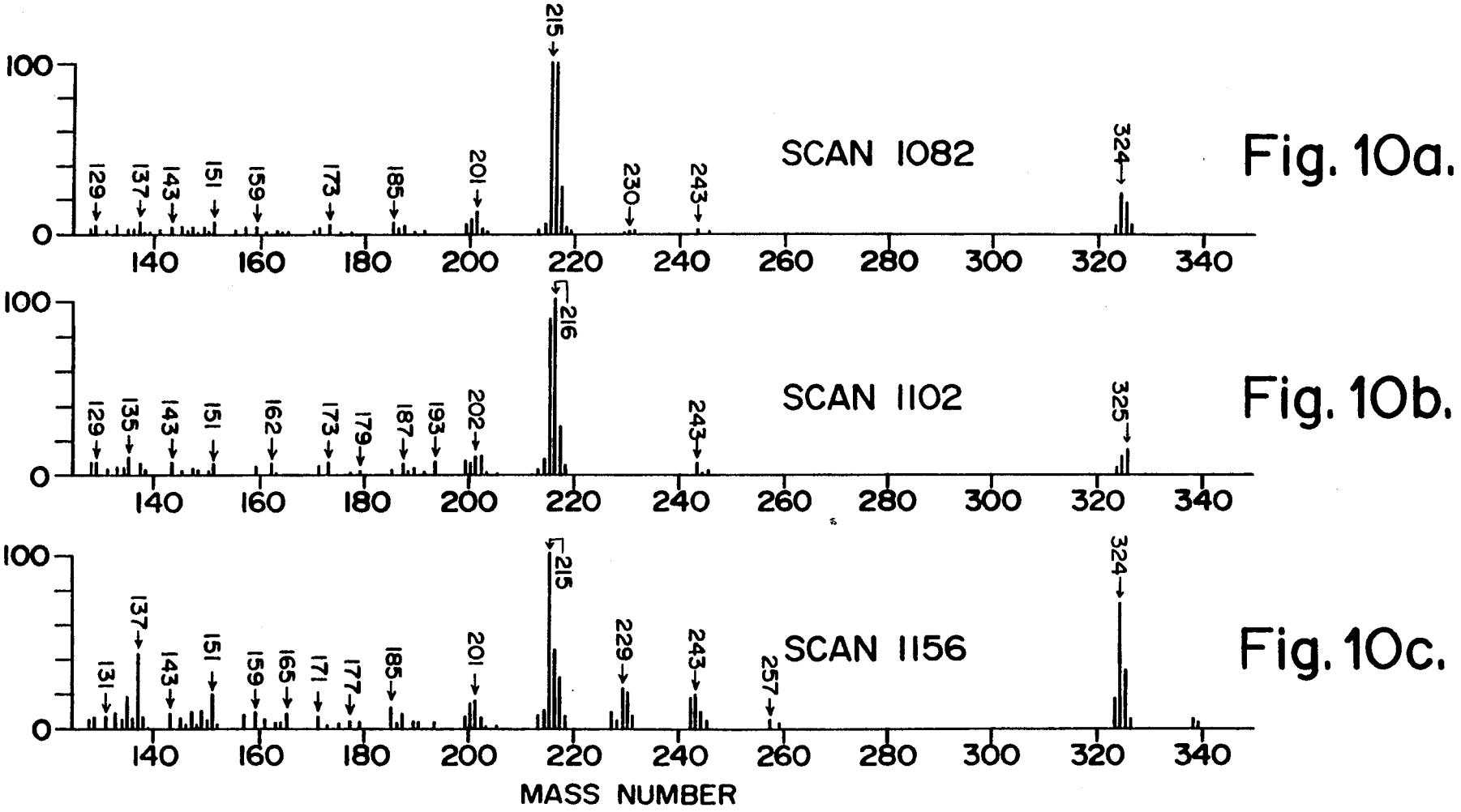
FIGS. 10*a*, 10*b*, 10*c* are the mass spectra of scans 1082(*a*), 1102(*b*) and 1156(*c*) of FIG. 9.
Figure 11:
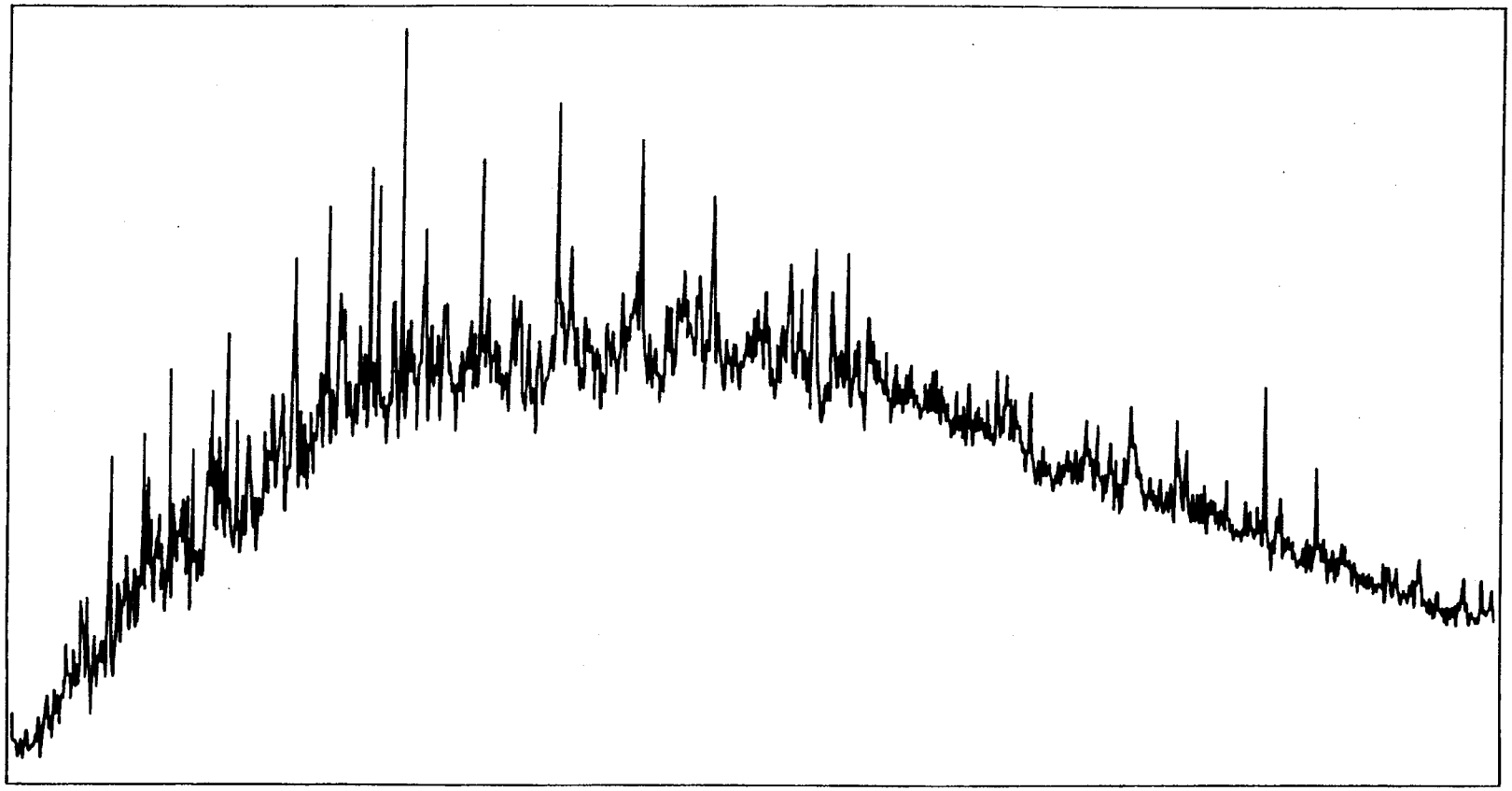
FIG. 11 is the gas chromatogram of the "saturate" fraction of superacid - treated CL bitumen.
Figure 12:
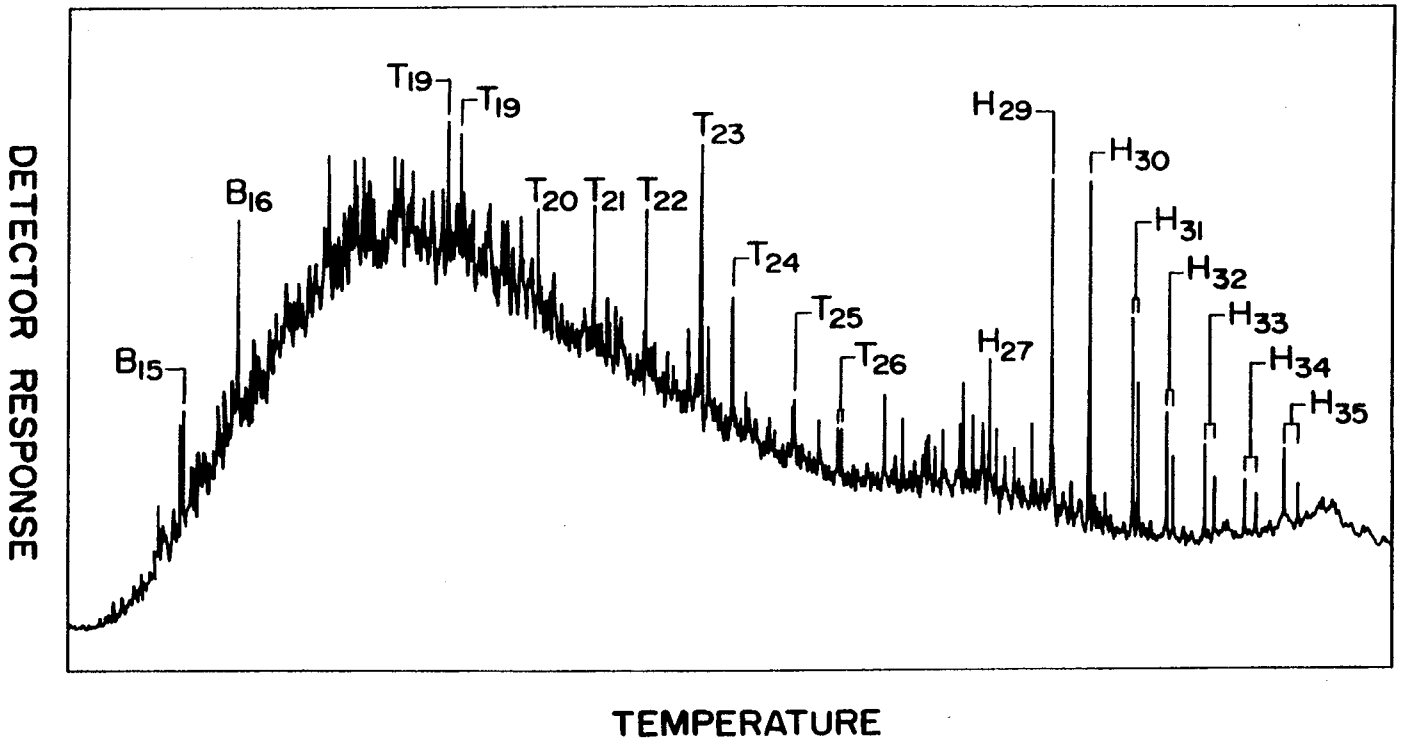
FIG. 12 is the gas chromatogram of the "saturate" fraction of Athabasca bitumen.
Figure 13:
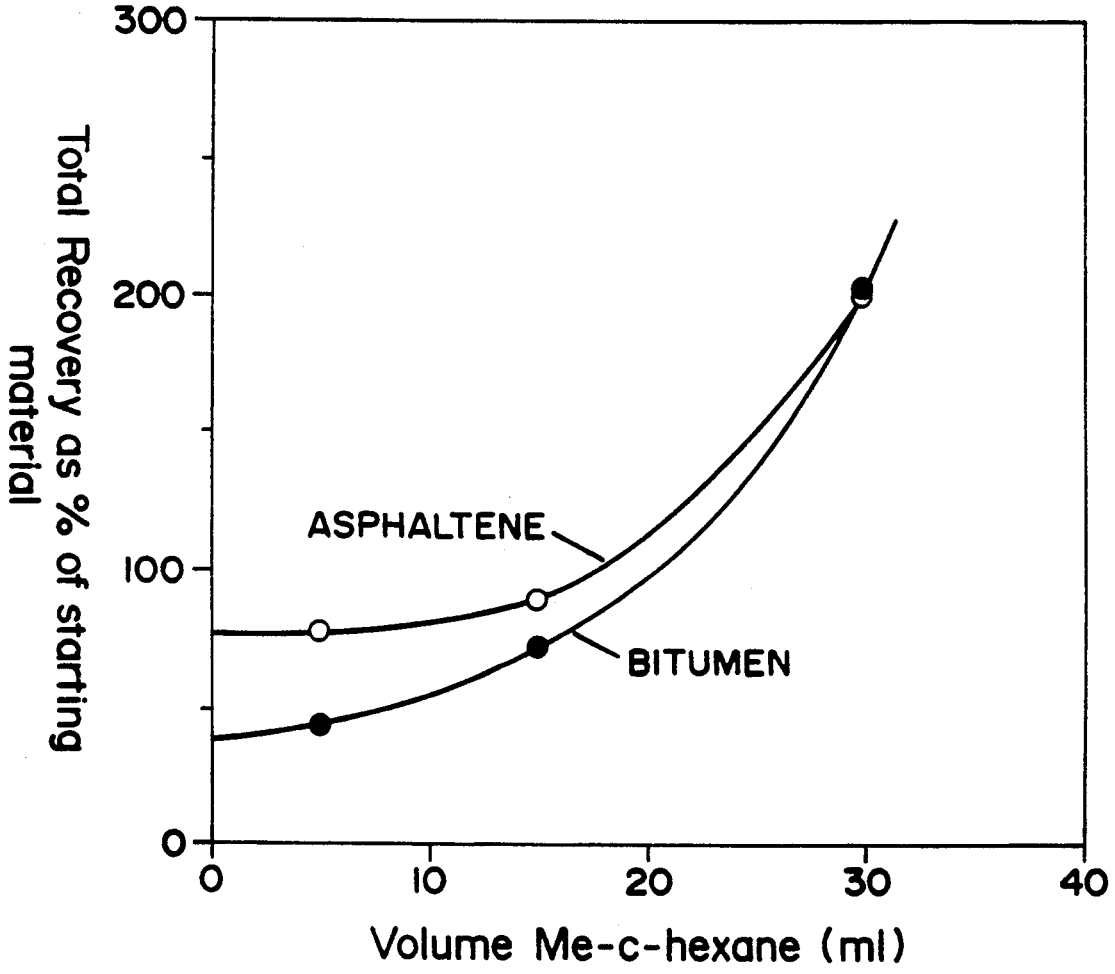
FIG. 13 is a plot of the total recovery as a percentage of the starting material utilized versus the volume of MeCH added.

Having reference to the accompanying drawings, there is provided an alternative process to the conventional catalytic hydrocracking of oil sand bitumens, heavy oil or chemically related feedbacks. More specifically, the process involves a superacid-catalyzed hydrocracking process which proceeds via a free radical (or ionic) mechanism. The preferred superacid catalyst would be in the gaseous state.

The sole superacid which is in the gaseous state is $HF.BF_3$, or fluoroboric acid. However, other superacids, or the salts thereof may be contemplated for use as catalysts. Exemplary superacids would include, but are not limtied to $HF.BF_3$, $H_2SiF_6$ and $HPF_6$ or the like.

It is desirable that the reaction take place in the presence of a hydrogen transfer agent. Suitable hydrogen transfer agents would include the cycloalkanes and low molecular weight alkanes. A particularly suitable hydrogen transfer agent is methylcyclohexane (MeCH). Contrary to expectation it was found that using MeCH as the solvent desirably resulted in the oligomerization of MeCH to produce conjugated olefinic oligomers. It had been anticipated that the MeCH would be inert under these experimental reaction conditions. Upon exposure to air, these oligomers reacted with oxygen, turning the clear liquid of the separated oligomers to a partially, soluble, translucent gum.

Various experiments were conducted both in the presence and absence of the MeCH solvent. In the presence of MeCH, the yields of non-volatile products were higher and were dependent upon the amounts of solvents used, as can be illustrated in tables 1–7 given hereinafter.

The hydrogenation reaction, typically, takes place under mild reaction conditions. The reaction temperatures range between 25° C. to 300° C. A preferred temperature between about 170° C. and 250° C. The reaction time can range from an instantaneous time to about 24 hours. Typically, a preferred reaction time is from about one hour to about twenty four hours. Preferred conditions for hydrocracking are such that the reaction is conducted at a pressure of 500 psi $H_2$.

TABLE 1

Superacid treatment of CL asphaltene

| | | |
|---|---|---|
| Reaction conditions: | | |
| 210° C. | | |
| 500 psi $H_2$ | | |
| 500 psi $BF_3$ | | |
| 50 mL HF | | |
| 30 mL MeCH | | |
| 2.50 g asphaltene | | |
| Reaction time 24 hrs | | |
| Product yields: | | |
| maltene | 5.59 g | 86.8% of product |
| asphaltene | 0.85 g | 13.2% of product |
| Class composition of maltene: | | |
| Saturates | 66.3 | |
| Monoaromatics | 13.2 | |
| Diaromatics | 4.4 | |
| Polyaromatics | 2.4 | |
| Polar | 13.6 | |
| Elemental analysis: | | |
| | maltene | asphaltene |
| C | 87.92 | 81.66 |
| H | 10.30 | 7.20 |
| N | 0.06 | 0.87 |
| S | 0.23 | 0.81 |
| O | 1.19 | 3.77 |
| MW | 329 | ND |
| $(H/C)_{atomic}$ | 1.53 | 1.05 |

TABLE 2

Superacid treatment of CL bitumen

| | | | |
|---|---|---|---|
| Reaction conditions: | | | |
| 285° C. | | | |
| 500 psi $H_2$ | | | |
| 500 psi $BF_3$ | | | |
| 50 mL HF | | | |
| 5 mL MeCH | | | |
| 3.5 g bitumen | | | |
| 24 hrs reaction time | | | |
| Product yields: | | | |
| maltene | 1.87 g | 85% of products | 53.4% of bitumen |
| asphaltene | 0.33 g | 15% of products | 9.4% of bitumen |
| Class composition of maltene: | | | |
| Saturates | 34.4 | | |
| Monoaromatics | 14.2 | | |
| Diaromatics | 11.2 | | |
| Polyaromatics | 17.7 | | |
| Polar | 22.5 | | |
| Elemental analysis: | | | |
| | maltene | asphaltene | |
| C | 84.25 | 80.18 | |
| H | 11.31 | 7.83 | |
| N | 0.22 | 1.05 | |
| S | 3.49 | 7.84 | |
| O | 0.79 | 2.27 | |
| MW | 447 | 2,345 | |
| $(H/C)_{atomic}$ | 1.6 | 1.16 | |

TABLE 3

Superacid treatment of Suncor Coker Feed bitumen

| | | | |
|---|---|---|---|
| Reaction conditions: | | | |
| 200° C. | | | |
| 500 psi $H_2$ | | | |
| 500 psi $BF_3$ | | | |
| 50 mL HF | | | |
| 30 mL MeCH | | | |
| 2.64 g bitumen | | | |
| 24 hrs reaction time | | | |
| Product yields: | | | |
| maltene | 5.5 g | 89.4% of products | 208% of bitumen |
| asphaltene | 0.65 g | 10.6% of products | 24% of bitumen |
| Class composition of maltene: | | | |
| Saturates | 54.4 | | |
| Monoaromatics | 22.7 | | |

TABLE 3-continued

| Superacid treatment of Suncor Coker Feed bitumen | | |
|---|---|---|
| Diaromatics | 2.7 | |
| Polyaromatics | 0.6 | |
| Polar | 19.6 | |
| | Elemental analysis: | |
| | maltene | asphaltene |
| C | 87.95 | 77.44 |
| H | 10.88 | 7.13 |
| N | 0.02 | 1.49 |
| S | 0.76 | 7.56 |
| O | 0.76 | 6.38 |
| MW | 324 | ND |
| $(H/C)_{atomic}$ | 1.47 | 1.10 |

TABLE 4

| Superacid treatment of Suncor Coker Feed asphaltene | | | |
|---|---|---|---|
| | Reaction conditions: | | |
| | 200° C. | | |
| | 500 psi $H_2$ | | |
| | 500 psi $BF_3$ | | |
| | 50 mL HF | | |
| | 30 mL MeCH | | |
| | 2.5 g bitumen | | |
| | 24 hrs reaction time | | |
| | Product yields: | | |
| maltene | 5.0 g | 84.9% of products | 200% of asphaltene |
| ashpaltene | 0.89 g | 15.1% of products | 35.6% of asphaltene |
| | Class composition of maltene: | | |
| Saturates | 39.2 | | |
| Monoaromatics | 41.4 | | |
| Diaromatics | 1.0 | | |
| Polyaromatics | 0.0 | | |
| Polar | 18.3 | | |
| | Elemental analysis: | | |
| | maltene | asphaltene | |
| C | 87.35 | 76.46 | |
| H | 10.81 | 7.51 | |
| N | 0.0 | 1.81 | |
| S | 0.74 | 7.33 | |
| O | 1.14 | 6.88 | |
| MW | 332 | ND | |
| $(H/C)_{atomic}$ | 1.47 | 1.17 | |

TABLE 5

Superacid treatment of Suncor Coker Feed bitumen and asphaltene. Effect of the quantity of MeCH added.[a]

| Expt. No. | 1 | 2 | 3 | 4 | 5 | 6 |
|---|---|---|---|---|---|---|
| Bitumen (g) | 2.69 | 2.88 | — | — | 3.08 | — |
| Asphaltene (g) | — | — | 2.50 | 2.50 | — | 2.50 |
| MeCH (mL) | 5 | 30 | 5 | 30 | 15 | 15 |

[a]Conditions: 1 h, 200° C., 500 psi $H^2$, 500 psi $BF_3$, 50 mL HF, reactor volume 25 mL

TABLE 6

Gravimetric results of superacid experiments on Coker Feed bitumen and aphaltene

| | Asphaltene | | Maltene | | Total recovery |
|---|---|---|---|---|---|
| Volume MeCH (mL) | % recovered | % of starting material | % recovered | % of starting material | % of starting material |
| Bitumen | | | | | |
| 5 mL | 18.5 | 8.1 | 81.5 | 35.7 | 43.8 |
| 15 mL | 13.1 | 9.4 | 86.9 | 62.3 | 71.7 |
| 30 mL | 5.8 | 11.7 | 94.2 | 191.6 | 203.3 |
| Asphaltene | | | | | |
| 5 mL | 57.1 | 44.6 | 42.9 | 33.5 | 78.1 |
| 15 mL | 54.6 | 49.2 | 45.3 | 40.8 | 90.0 |

TABLE 6-continued

Gravimetric results of superacid experiments on Coker Feed bitumen and aphaltene

| | Asphaltene | | Maltene | | Total recovery |
|---|---|---|---|---|---|
| Volume MeCH (mL) | % recovered | % of starting material | % recovered | % of starting material | % of starting material |
| 30 mL | 19.1 | 38.4 | 80.9 | 161.6 | 200.0 |

[a]Asphaltene content of bitumen was 15.5%.

TABLE 7

Class composition of the maltenes[a]

| | | Superacid experiment | | | |
|---|---|---|---|---|---|
| Fraction | Starting material | 1 (bitumen) | 2 (bitumen) | 3 (asphaltene) | 4 (asphaltene) |
| Saturates | 24.9 | 27.0 | 58.9 | 20.8 | 42.7 |
| Monoaromatics | 10.8 | 9.6 | 18.2 | 4.6 | 22.2 |
| Diaromatics | 8.5 | 4.4 | 0.5 | 1.5 | 1.4 |
| Polyaromatics | 20.0 | 8.7 | 1.0 | 6.0 | 1.1 |
| Polars | 35.8 | 50.2 | 21.4 | 67.0 | 32.6 |

[a]As wt % of maltene. Separation done on an alumina/silica gel column.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

The embodiments of the invention in which an exclusive property or privilege are claimed are defined as follows:

1. A process for hydrocracking a heavy oil or bitumen which comprises reacting said feedstock with a gaseous superacid in the presence of a hydrogen transfer agent and hydrogen to thereby yield lower boiling point distillates in the absence of a solid catalyst.

2. The process as set forth in claim 1 wherein said hydrogen transfer agent is selected from a cycloalkane or a low molecular weight alkane.

3. The process as set forth in claim 1 wherein said gaseous superacid comprises $HF.BF_3$.

4. A process for hydrocracking a heavy oil or bitumen which comprises hydrogenating said feedstock with a gaseous superacid in the presence of a hydrogen transfer agent at a temperature varying from between about 25° C. to about 300° C. in the absence of a solid catalyst.

5. The process as set forth in claim 3 wherein said hydrogen transfer agent is selected from a cycloalkane or a low molecular weight alkane.

6. The process as set forth in claim 5 wherein said hydrogen transfer agent comprises methylcyclohexane.

7. The process as set forth in claim 5 wherein said hydrogen transfer agent comprises methylcyclopentane.

8. The process as set forth in claim 5 wherein said hydrogen transfer agent comprises dimethylcyclohexane.

9. The process as set forth in claim 5 wherein said hydrogen transfer agent comprises dimethyclopentane.

10. The process as set forth in claim 4 wherein said reaction temperature ranges from about 170° C. to about 250° C.

11. The process as set forth in claim 3 wherein the pressure of $HF.BF_3$ is about 500 psi.

12. The process as set forth in claim 2 wherein said hydrogen transfer agent comprises methylcyclohexane.

13. The process as set forth in claim 2 wherein said hydrogen transfer agent comprises methyclyclopentane.

14. The process as set forth in claim 2 wherein said hydrogen transfer agent comprises dimethylcyclohexane.

15. The process as set forth in claim 2 wherein said hydrogen transfer agent comprises dimethylcyclopentane.

16. A process for hydrocracking a heavy oil or bitumen which comprises hydrogenating said feedstock with fluoroboric acid at a temperature ranging from between about 25° C. to about 300° C. for a time ranging from about one hour to about 24 hours in the absence of a solid catalyst.

17. The process as set forth in claim 16 wherein the hydrogenation process further includes the addition of a hydrogen transfer agent selected from a cycloalkane or a low molecular weight alkane.

18. The process as set forth in claim 17 wherein said hydrogen transfer agent comprises methylcyclohexane.

19. The process as set forth in claim 2 wherein said gaseous superacid comprises $HF.BF_3$.

20. The process as set forth in claim 5 wherein said reaction temperature ranges from about 170° C. to about 250° C.

* * * * *